US011478088B2

(12) United States Patent
Goppion

(10) Patent No.: US 11,478,088 B2
(45) Date of Patent: Oct. 25, 2022

(54) MUSEUM SHOWCASE WITH A GUIDE SYSTEM FOR A SLIDING DOOR

(71) Applicant: GOPPION S.p.A., Trezzano sul Naviglio (IT)

(72) Inventor: Alessandro Goppion, Milan (IT)

(73) Assignee: GOPPION S.p.A., Trezzano sul Naviglio (IT)

( * ) Notice: Subject to any disclaimer, the term of this patent is extended or adjusted under 35 U.S.C. 154(b) by 83 days.

(21) Appl. No.: 17/165,296

(22) Filed: Feb. 2, 2021

(65) Prior Publication Data

US 2021/0235887 A1 Aug. 5, 2021

(30) Foreign Application Priority Data

Feb. 3, 2020 (IT) ..... 102020000002086

(51) Int. Cl.

| | |
|---|---|
| ***A47F 3/00*** | (2006.01) |
| ***E05D 15/06*** | (2006.01) |
| ***A47F 3/12*** | (2006.01) |

(52) U.S. Cl.

CPC ..... *A47F 3/005* (2013.01); *A47F 3/125* (2013.01); *E05D 15/06* (2013.01); *E05Y 2900/202* (2013.01)

(58) Field of Classification Search

CPC ..... A47F 3/005; A47F 3/125; E05D 15/06
USPC ..... 312/139.2
See application file for complete search history.

(56) References Cited

U.S. PATENT DOCUMENTS

| | | | | |
|---|---|---|---|---|
| 3,401,994 A * | 9/1968 | Diack | ..... | A47F 3/125 312/139.2 |
| 4,073,034 A * | 2/1978 | Martens | ..... | E05D 15/063 16/87 R |
| 5,069,512 A * | 12/1991 | Sykes | ..... | E06B 5/006 312/139.2 |
| 5,987,817 A | 11/1999 | Hein | | |
| 6,793,298 B2 * | 9/2004 | Delph | ..... | A47B 96/00 312/139.2 |

FOREIGN PATENT DOCUMENTS

| | | |
|---|---|---|
| CN | 203860729 U | 10/2014 |
| CN | 204876979 U | 12/2015 |

(Continued)

OTHER PUBLICATIONS

European Office Action dated Jun. 15, 2021, issued in the corresponding European application.

*Primary Examiner* — James O Hansen
(74) *Attorney, Agent, or Firm* — Husch Blackwell LLP

(57) ABSTRACT

A museum showcase includes a guide system for a sliding door, including upper and lower guide mechanisms. The upper guide mechanism includes primary and secondary rails. The upper guide mechanism also includes a first slide unit and a second slide unit. The first slide unit has a rolling member on an upper horizontal track of the secondary rail, and a sliding block engaged on a vertical track of the secondary rail. The second slide unit has a rolling member on a lower horizontal track of the primary rail, and a sliding block engaged on a vertical track of the primary rail. Thereby, the upper guide mechanism is extremely strong. The weight of the door, entirely supported by the secondary rail, is discharged on the first rail by the two slide units to transmit both vertical and horizontal loads.

9 Claims, 7 Drawing Sheets

(56) References Cited

FOREIGN PATENT DOCUMENTS

| | | | |
|---|---|---|---|
| CN | 105804569 | A | 7/2016 |
| DE | 202004003157 | U1 | 6/2004 |
| ES | 2319092 | T1 | 5/2009 |
| KR | 1020130114503 | A | 10/2013 |
| WO | 2015/111009 | A1 | 7/2015 |

* cited by examiner

MUSEUM SHOWCASE WITH A GUIDE SYSTEM FOR A SLIDING DOOR

CROSS REFERENCE

This application claims the priority of, and expressly incorporates by reference herein the entire disclosure of, Italian Patent Application No. 102020000002086, filed Feb. 3, 2020.

FIELD OF THE DISCLOSURE

The present invention relates to a museum showcase, that is a showcase for preserving and displaying objects, such as typically artworks, cultural heritage objects or in any case delicate objects, in museums, exhibitions and the like. In the following, even where only the term showcase is used, it must be understood that it refers to a museum showcase.

BACKGROUND

In particular, the showcase can simply enclose the artworks, preventing the contact by people or things, or it can be such as to guarantee the preservation of the artworks in a protected environment; protected environment means here and hereinafter an environment in which the atmosphere is controlled, by monitoring one or more parameters among temperature, humidity, dust content, pollutant content, in order to maintain the expected conditions of preservation of the exhibits, and in which the possibility of access to unauthorized personnel is prevented, to avoid theft or damage to the exhibits.

Showcases of this type must therefore meet various requirements, in relation to preservation and integrity of the exhibits. In addition, these showcases must of course guarantee the best visibility for the exhibits.

In order to improve visibility, showcase manufacturers try as far as possible to use transparent materials—typically glass—for the fixed walls and the openable doors of the showcases. In addition to ensuring the best visibility of the exhibits, the extensive use of glass is often desired by showcase designers because the transparency of the material makes it possible to give maximum prominence to the exhibits. However, this material implies a rather high weight, which can create difficulties in moving the openable doors.

In addition, to facilitate the insertion and removal of the exhibits, showcases are often used having doors sliding with respect to a fixed casing, wherein the opening takes place by sliding an openable door that practically forms an entire wall or a large part thereof.

When the openable door is made of glass and is large in size, with heights and widths of a few meters, the sliding opening thereof may cause stability problems. In fact, the sliding determines a displacement of a remarkable mass (also of some hundreds of kilograms) from a closed position that is substantially centred and balanced with respect to the casing to a lateral-cantilevered open position. This makes it necessary to suitably anchor (to the ground and/or wall) the casing, to prevent the showcase from possibly overturning. However, the possible overturning is not the only danger; in fact, displacing such a high mass in a cantilever fashion may cause deformation of the guide systems resulting also in very serious consequences, ranging from sliding problems, to a door block, up to the sudden release of the door from the casing of the showcase.

Moreover, a very high door made of glass is likely to significantly flex with respect to the vertical plane, thus losing planarity which hinders and also prevents the door from being properly sealingly closed. To avoid this inflection, the door is supported and guided in a hung condition. In this case, the door is supported by an upper guide mechanism of the guide system, onto which all the weight of the door is discharged, which weight tends to keep the door plane and vertical. A lower guide mechanism of the guide system is in any case present but it is only for keeping the proper vertical inclination of the door.

However, if the sliding door is hung, the above-noted stability problems are emphasized, as only the upper guide mechanism is in charge of bearing the cantilever weight.

All these problems and dangers (obviously unacceptable for any showcase user) determine as such a limitation in the maximum dimensions of the sliding doors, or require load-bearing structures placed outside the showcase (such as sliding rails anchored to the building ceiling or walls).

Therefore, there exists a problem of making showcases provided with sliding doors, even large in size and guided in a hung condition, wherein it is possible to guarantee the required safety, without involving complicated opening and closing operations and without requiring load-bearing structures placed outside the showcase.

SUMMARY OF THE DISCLOSURE

Accordingly, the present invention relates to a showcase according to claim 1; preferred characteristics are reported in the dependent claims.

More particularly, according to the invention, a museum showcase comprises a casing, at least one sliding door and a guide system for a sliding door, wherein the guide system comprises an upper guide mechanism and a lower guide mechanism, and wherein the door is hung on the casing through the upper guide mechanism, which bears the weight thereof while the lower guide mechanism determines the inclination thereof in relation to the vertical axis. The upper guide mechanism comprises a primary rail and a secondary rail placed side by side and extended parallel in a same opening direction wherein the primary rail is fastened to the casing and is extended between a first end and a second end, and the secondary rail is fastened to the door at one of the upper edges thereof and is extended between a first end and a second end; the secondary rail is mounted sliding in relation to the primary rail along said opening direction in such a way that it can slide between a closed position of the door and an open position of the door, wherein in the closed position of the door the first and the second end of the secondary rail are respectively at the first and the second end of the primary rail, while in the open position of the door the second end of the secondary rail is brought closer to the first end of the primary rail and brought farther away from the second end of the primary rail.

The upper guide mechanism then comprises a first slide unit fastened to the primary rail at its first end and in sliding engagement with the secondary rail, and a second slide unit fastened to the secondary rail at its second end and in sliding engagement with the primary rail; the first slide unit comprises a rolling member in sliding engagement from below on a top horizontal track of the secondary rail facing downwards, and a sliding block engaged on a vertical track of the secondary rail facing the opposite side of the primary rail; the second slide unit comprises a rolling member in sliding engagement from above on a lower horizontal track of the primary rail facing upwards, and a sliding block engaged on a vertical track of the primary rail facing the opposite side of the secondary rail.

Thereby, the structure of the upper guide mechanism, which is intended to bear the weight of the sliding door, is extremely strong. The weight of the door, entirely supported by the secondary rail, is discharged on the first rail by the two slide units, which ensure transmitting not only vertical loads (thanks to the rolling members) but also horizontal loads (thanks to the sliding blocks) due to the weight in the cantilevered position when the door is open.

Preferably, the first slide unit comprises a further sliding block engaged on a further vertical track of the secondary rail facing the opposite side of the primary rail, and wherein the second slide unit comprises a further sliding block engaged on a further vertical track of the primary rail facing the opposite side of the secondary rail, the further vertical tracks of the primary rail and of the secondary rail being spaced vertically in relation to the respective vertical tracks. Being engaged on double vertical tracks improves the ability of bearing high strains in a horizontal direction with no significant deformation, especially thanks to the vertical spacing.

Preferably, in each slide unit the sliding block and the additional sliding block are constrained to each other in a vertical direction and embrace the primary or secondary rail on which they are in sliding engagement on opposite sides in the vertical direction. The assembly formed by the sliding block and the additional sliding block thus forms a structure embracing the primary or secondary rail, thus guaranteeing the stability of the hooking.

Preferably, the sliding blocks and the further possible sliding blocks are in sliding engagement on the respective vertical tracks, with or without interposition of rolling members.

Preferably, the primary and/or secondary rail have a C or tilted H (or double T) cross section. These sections are particularly suitable for bearing high bending loads, despite they are relatively small in size, thanks to their favourable inertia momentum, and thus guarantee that the first and secondary rails may be easily sized such to bear even very high loads.

Preferably, the lower guide mechanism comprises a lower rail and a rod placed side by side and extended parallel in the opening direction of the door, wherein one of the lower primary rail and the rod is fastened to the casing while the other one is fastened to the door, at a lower edge thereof; the lower guide mechanism further comprises a third slide unit, comprising a plurality of rolling members or sliding blocks, mounted on the rod and engaged between two facing vertical tracks of the lower rail. As the lower guide mechanism is not subjected to high loads as it is not involved in supporting the weight of the door, it can have a much simpler structure than the upper guide mechanism.

Preferably, the rolling members of the third slide unit are vertical-axis rollers, which guarantee a high sliding ability in a simple way.

Preferably, the primary rail and the lower rail if present are fastened to the casing through respective translation mechanisms, so as to be able to take a position close to the casing and a position spaced from the casing. Thereby, in addition to the sliding movement for opening the door, a movement is also provided for bringing the door close to the casing, making it possible to press the elastic gaskets and thus to seal the showcase properly.

BRIEF DESCRIPTION OF DRAWINGS

Further characteristics and advantages of a museum showcase according to the invention will become clearer from the following description of one preferred embodiment thereof, made with reference to the appended drawings. In such drawings.

DETAILED DESCRIPTION

Figure 1:
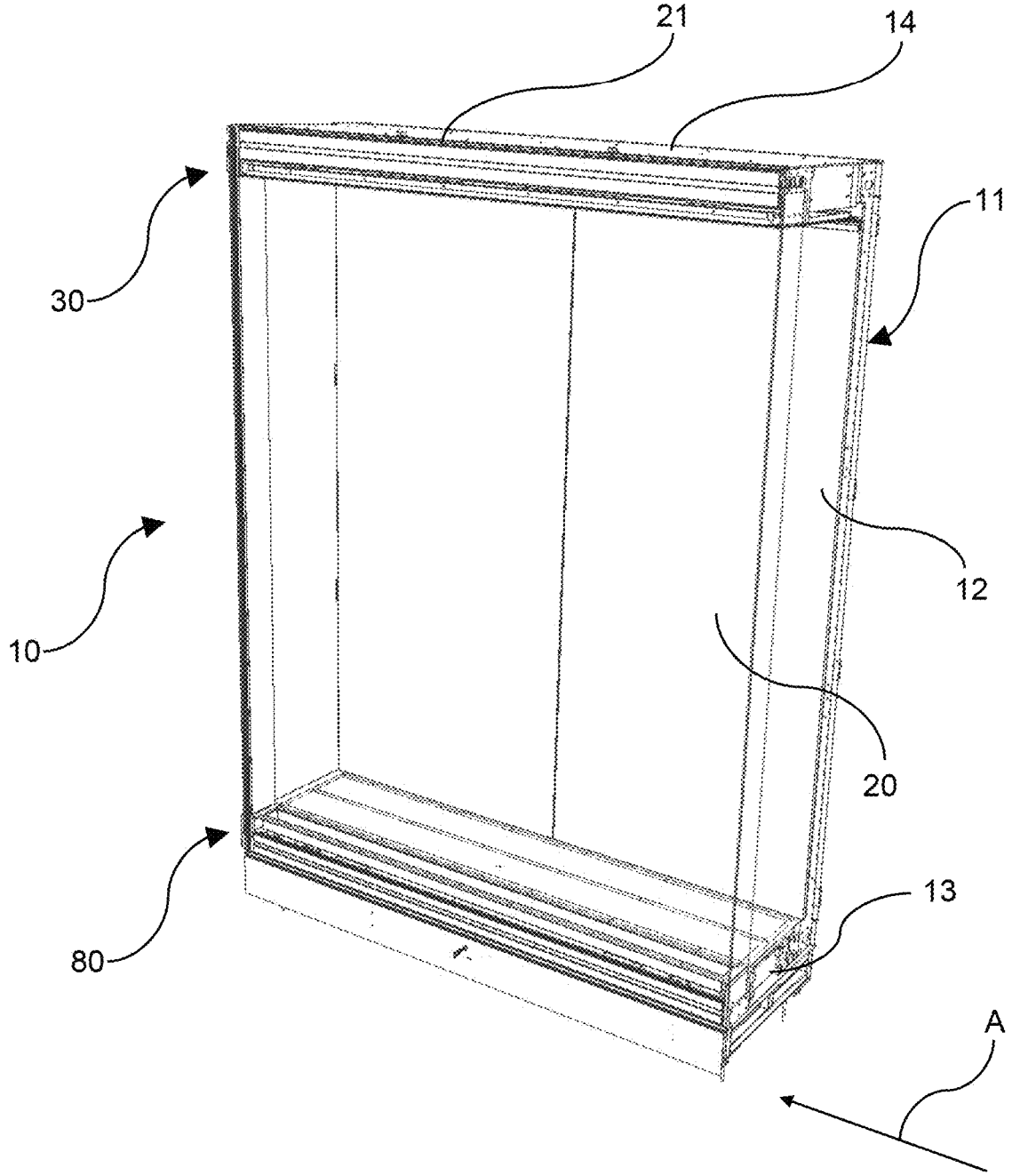
FIG. 1 is a schematic perspective view of a showcase according to the invention, with the openable door closed.
Figure 2:
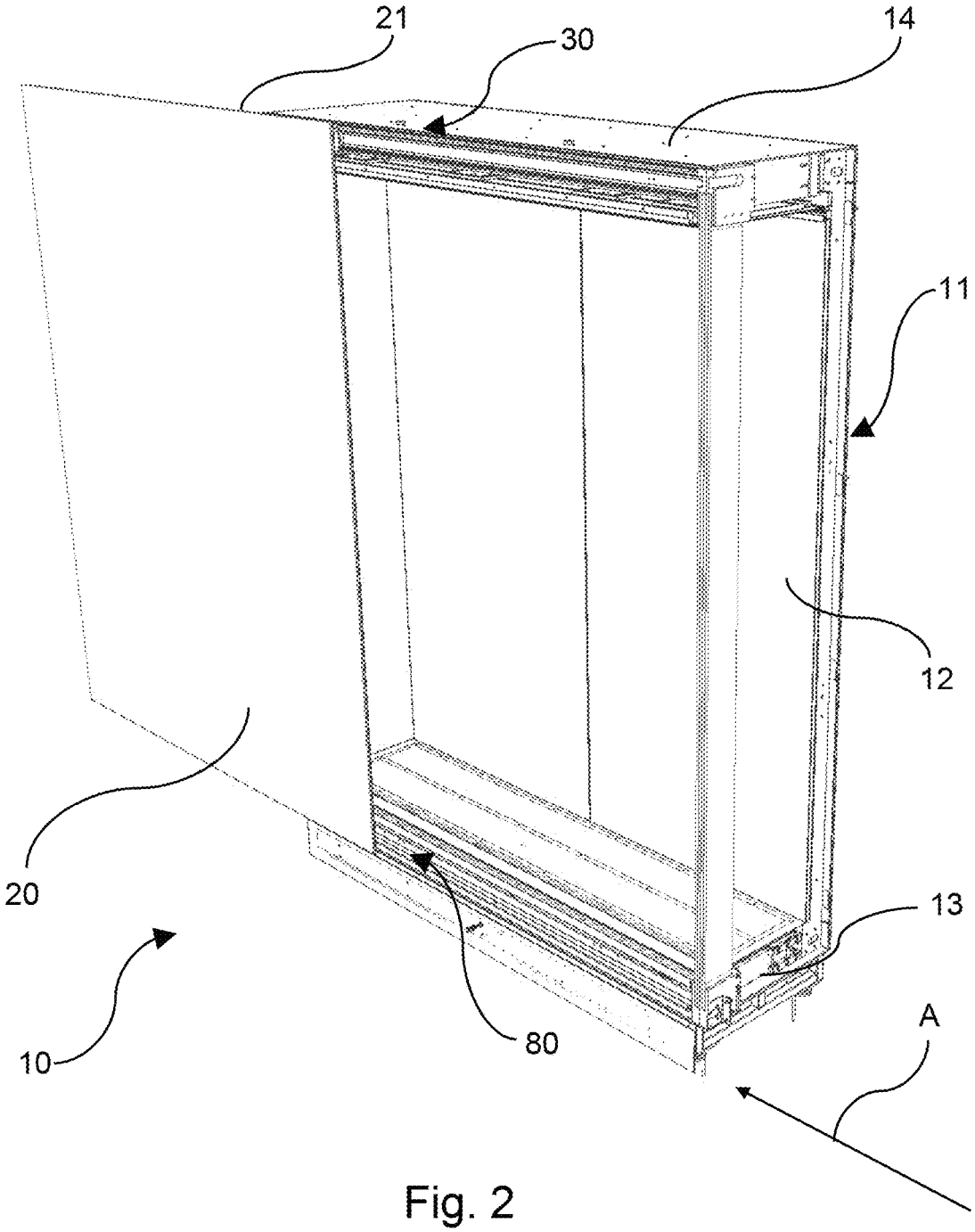
FIG. 2 is a schematic perspective view of the showcase of FIG. 1, with the openable door open.
Figure 3:
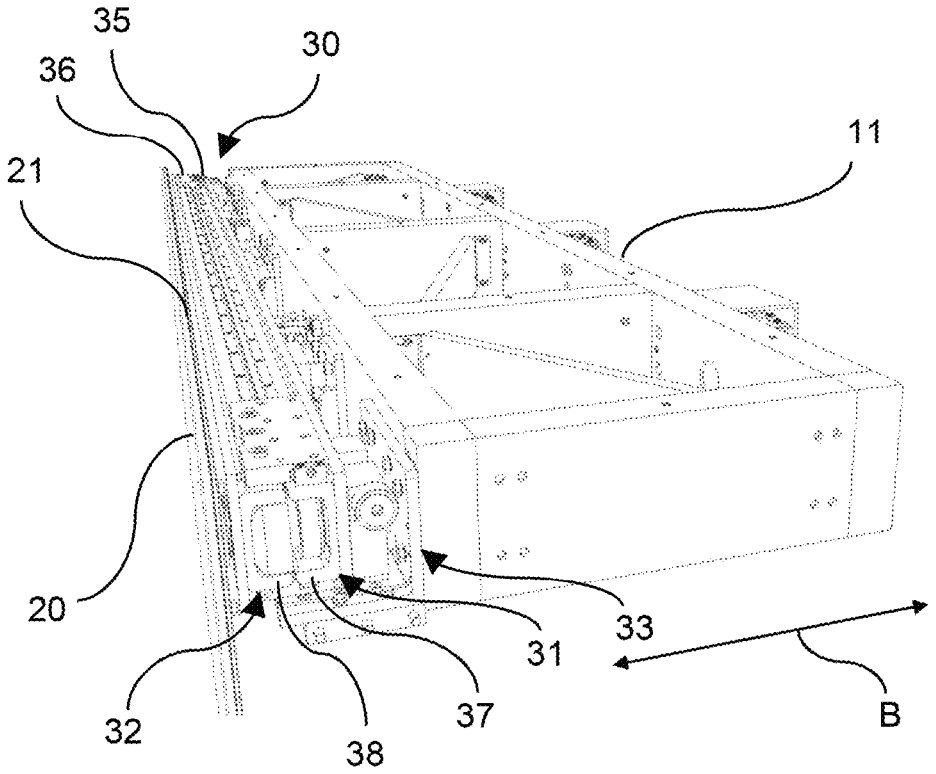
FIG. 3 is a partial view of the upper part of the showcase of FIG. 1 with the upper guide mechanism.
Figure 4:
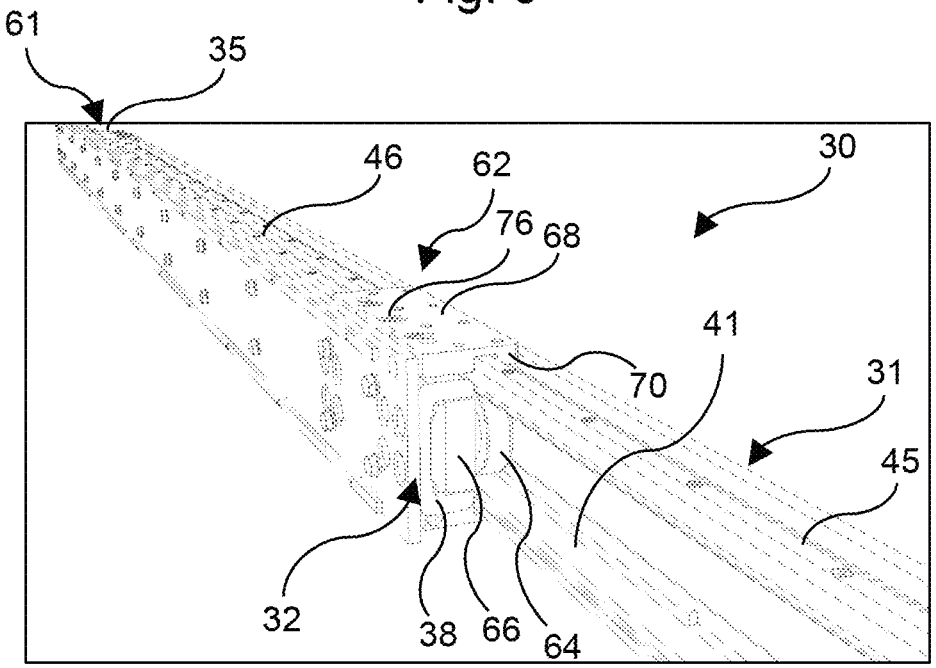
FIG. 4 is a view of the only upper guide mechanism of the showcase of FIG. 1.

In the figures, in particular in FIGS. 1 and 2, a museum showcase is indicated as a whole by 10, which comprises a fixed casing 11, in turn made of fixed walls 12 (opaque or transparent) mounted on a base 13 and upperly closed by a ceiling 14. The casing 11 is closed at the front by a sliding openable door 20. The showcase 10 must be intended as provided with all the typical elements of a museum showcase, such as sealing gaskets, climate control systems, safety systems and the like, and it can also be provided with air purification systems, lighting systems, control systems or other, even if they are not visible in the schematic representation of the drawings; on the other hand, all these elements are per se conventional.

The openable door 20 substantially occupies a whole front side of the showcase 10 and—as said—it is a sliding door, supported by the casing 11 by a guide system which comprises an upper guide mechanism 30 and a lower guide mechanism 80; they allow opening and closing the door 20 by sliding along an opening direction A. More in particular, as will be clearer from the hereinafter description, the door 20 is hung with an upper edge thereof 21 to the upper guide mechanism 30 while the lower guide mechanism 80 determines the inclination thereof, substantially keeping it in a vertical position while sliding in the opening direction A. The fact that the door 20 is hung makes it possible for it to stay always perfectly plane, without undergoing inflections which may result from the weight of the door 20 in case it was supported from below.

The upper guide mechanism 30 comprises a pair of rails, a primary rail 31 and a secondary rail 32, both extended in the opening direction A and coupled between each other.

The primary rail 31 is mounted on top of the casing 11, at the ceiling 14, fastened between a first translation mechanism 33 (not shown in detail nor described, in that it is per se conventional), which allows the translation of the primary rail 31 closer to or farther from the casing 11, in a horizontal approach direction B, perpendicular to the sliding direction A; thereby, the primary rail 31 (and the door 20 therewith) may take a position close to the casing 11, wherein the showcase gaskets 10 are properly pressed to ensure tightness, and a position spaced from it, wherein the door 20 may be slid in the opening direction A.

The secondary rail 32 is fastened to the door 20 at the upper edge 21 thereof and it is mounted as mobile on the primary rail 31 such that it can be slid in the opening direction A. Thanks to the sliding of the secondary rail 32 relative to the primary rail 31, the door 20 is mobile between a closed position (FIG. 1) and an open position (FIG. 2). In the door 20 closed position, one first and one second end 35 e 37 of the primary rail 31 are respectively at one first and one second end 36 and 38 of the secondary rail 32. When the door 20 is moved to its open position, the second end 38 of the secondary rail 32 is brought farther away from the second end 37 of the primary rail 31, being brought closer to the first end 35 of the primary rail 31; the first end 36 of the secondary rail 32 is brought farther away in a cantilever fashion from the first end 35 of the primary rail 31.

The primary rail 31 and the secondary rail 32 both have a C section, or in any case a section including a C-shaped portion (such as for instance a H section). More precisely, the primary rail 31 has a C section comprising in its lower zone a lower horizontal track 41, facing upwards, opposite to a higher horizontal track 43, facing downwards; similarly, the second rail 32 has a C section comprising in its lower zone a lower horizontal track 42, facing upwards, opposite to an upper horizontal track 44, facing downwards.

Furthermore, the primary rail 31 and the secondary rail 32 are provided with respective upper longitudinal projections 45 and 46, formed on the tracks behind the upper horizontal tracks 43 and 44, and preferably with respective lower longitudinal projections 47 and 48, formed on the rails behind the lower horizontal tracks 41 and 42. On the sidewall of the upper longitudinal projection 45 facing the opposite side relative to the secondary rail 32, a vertical track 51 of the primary rail 31 is formed; on the sidewall of the lower longitudinal projection 47 facing the opposite side relative to the secondary rail 32 a further vertical track 53 of the primary rail 31 is formed. On the sidewall of the upper longitudinal projection 46 facing the opposite side relative to the primary rail 31 a vertical track 52 of the secondary rail 32 is formed; on the sidewall of the lower longitudinal projection 48 facing the opposite relative to the primary rail 31 a further vertical track 54 of the secondary rail 32 is formed.

To allow or in any case ease the guided sliding of the secondary rail 32 on the primary rail 31, two slide units are provided: one first slide unit 61 and one second slide unit 62. The first slide unit 61 is fastened to the primary rail 31 at its first end 35 and is in sliding engagement with the secondary rail 32; the second slide unit 62 is fastened to the secondary rail 32 at its second end 38 and is in sliding engagement with the primary rail 31.

Figure 5:
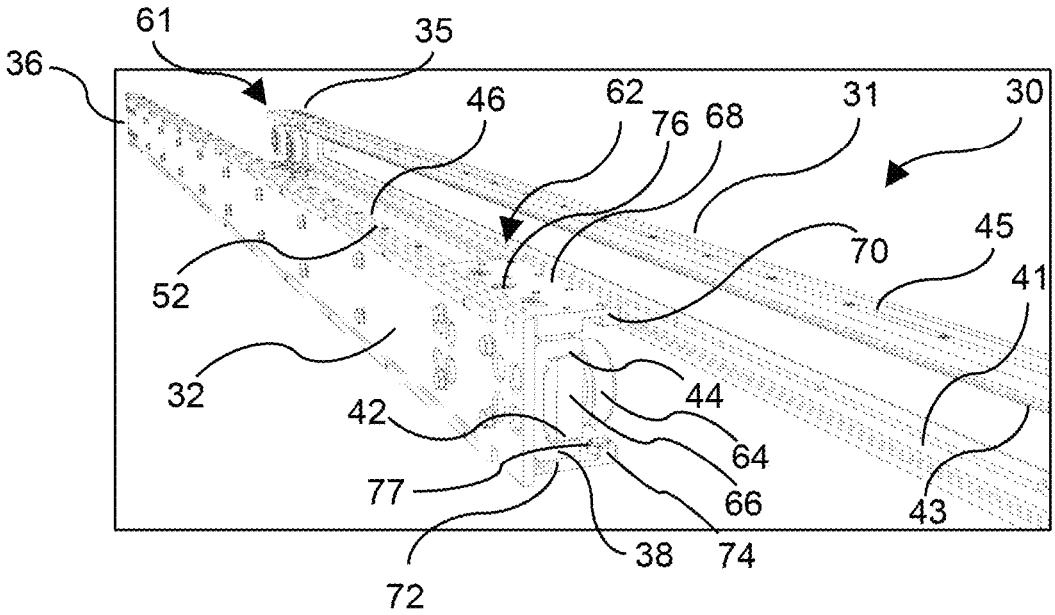
FIG. 5 is a view with separate parts of the upper guide mechanism of FIG. 4.
Figure 6:
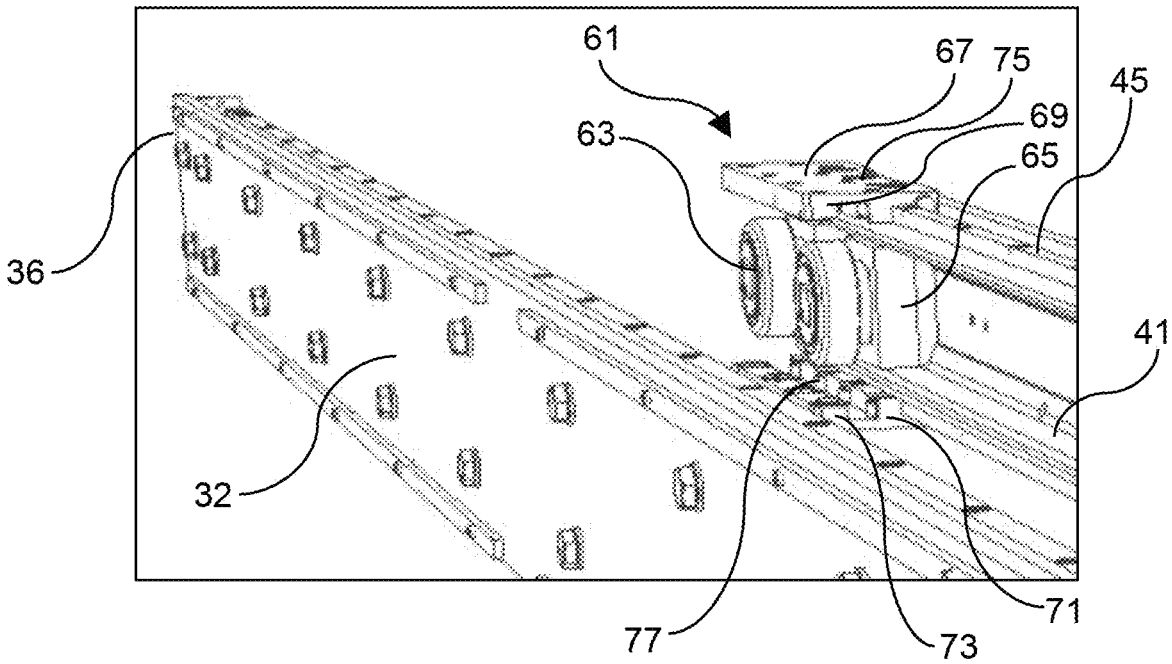
FIG. 6 shows a detail of FIG. 5 in enlarged scale.
Figure 7:
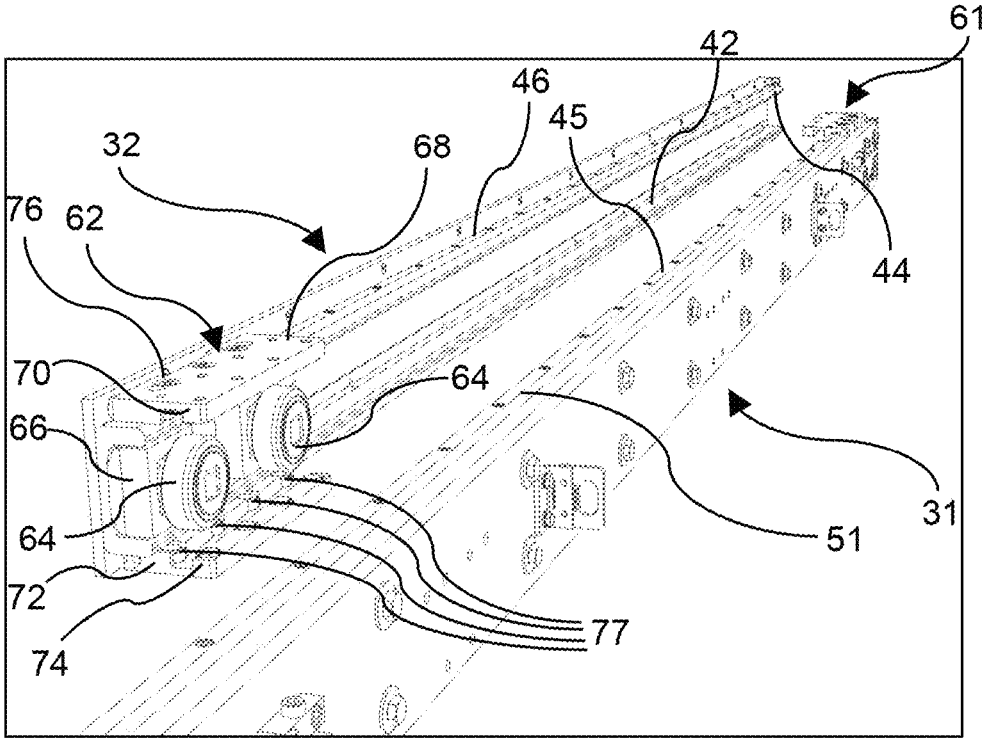
FIG. 7 is a different view with separate parts of the upper guide mechanism of FIG. 4.
Figure 8:
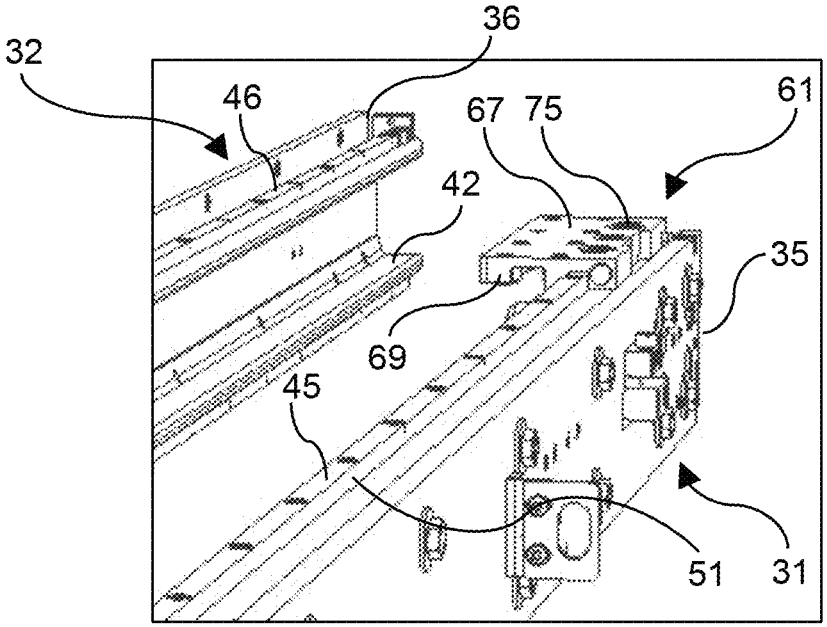
FIG. 8 shows a detail of FIG. 7 in enlarged scale.
Figure 9:
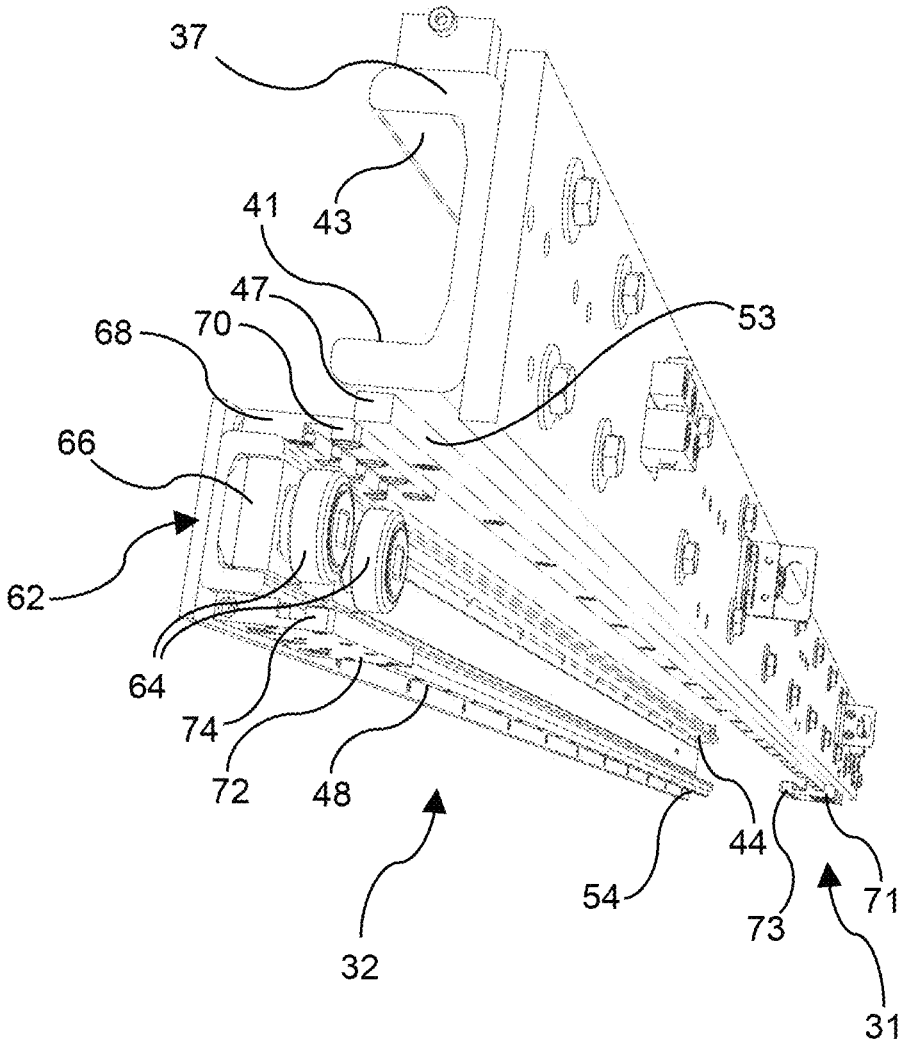
FIG. 9 is a further view with separate parts of the upper guide mechanism of FIG. 4.
Figure 10:
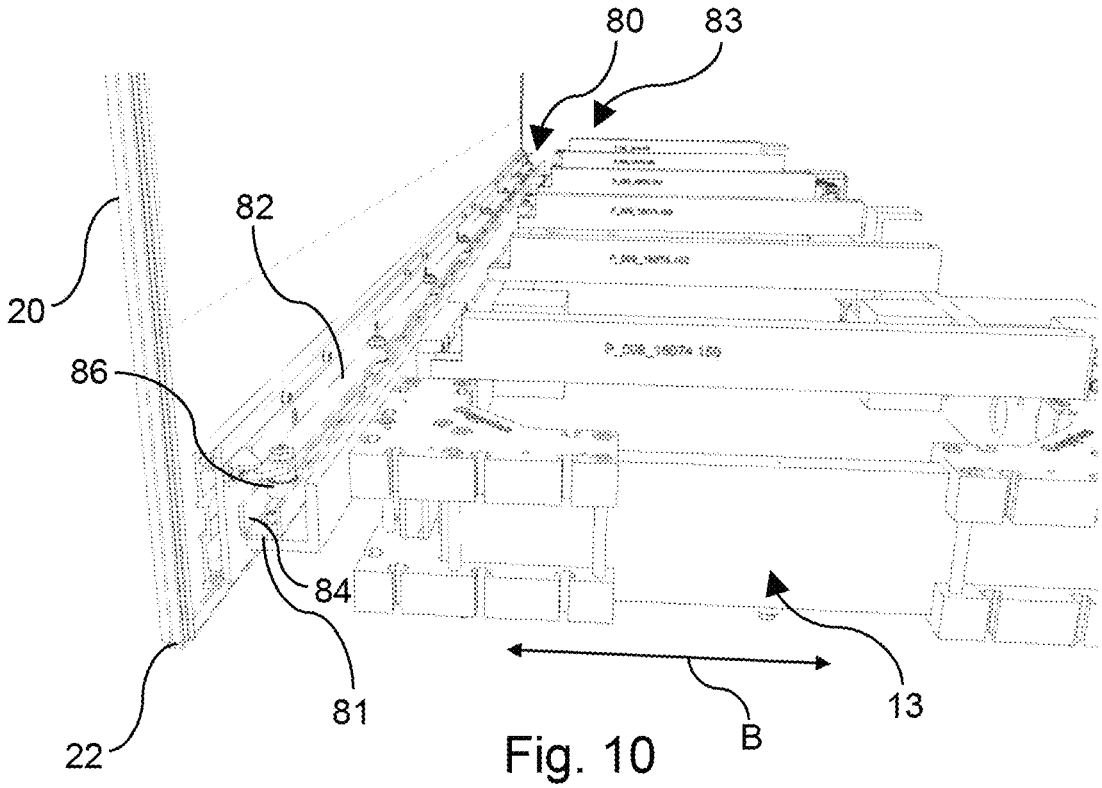
FIG. 10 is a partial view of the lower part of the showcase of FIG. 1 with the lower guide mechanism.
Figure 11:
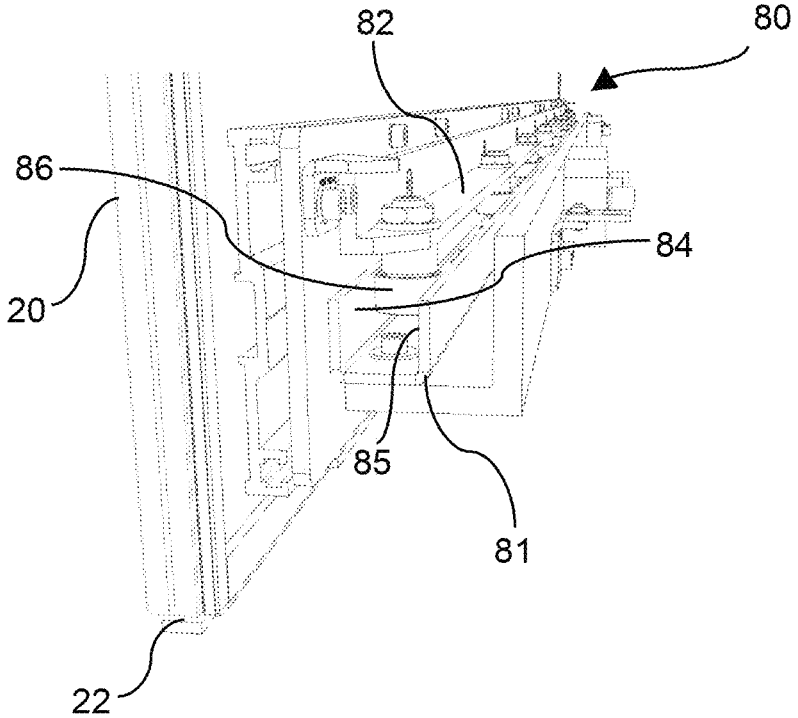
FIG. 11 is a view of the only lower guide mechanism of the showcase of FIG. 1.

The first slide unit 61 comprises a rolling member 63, formed of horizontal-axis rollers (two rollers placed one next to the other in the showcase 10, as visible in FIG. 6), supported by a body 65 stably fastened to the primary rail 31, between the two horizontal tracks 41 and 43 and in rolling engagement with the secondary rail 32, in particular with the upper horizontal track 44. The second slide unit 62 comprises a rolling member 64, formed of horizontal-axis rollers (two rollers placed one next to the other in the showcase 10, as visible in FIGS. 5, 7, 9), supported by a body 66 stably fastened to the secondary rail 32, between the two horizontal tracks 42 and 44 and in rolling engagement with the secondary rail 31, in particular with the upper horizontal track 41.

The first slide unit 61 comprises a sliding block 67, upperly stably fastened to the primary rail 31, behind the horizontal track 43, and provided with a portion 69 in a sliding engagement with the secondary rail 32, in particular with the vertical track 52. The second slide unit 62 comprises a sliding block 68, upperly stably fastened to the secondary rail 32, behind the horizontal track 44, and provided with a portion 70 in a sliding engagement with the primary rail 31, in particular with the vertical track 51.

The first slide unit 61 comprises a further sliding block 71, lowerly stably fastened to the primary rail 31, behind the horizontal track 41, and provided with a portion 73 in a sliding engagement with the secondary rail 32, in particular with the further vertical track 54. The second slide unit 62 comprises a sliding block 72, lowerly stably fastened to the primary rail 32, behind the horizontal track 42, and provided with a portion 74 in a sliding engagement with the primary rail 31, in particular with the further vertical track 53.

The sliding blocks 67 and 68 and the further sliding blocks 71 and 72 are in a sliding engagement with the vertical tracks 52 and 51 and the further vertical tracks 54 and 53, by interposition of rolling members, all of which are indicated by 77.

In the slide unit 61, the sliding block 67, the body 65 and the further sliding block 71 are constrained between each other and the primary rail 31 by means of vertical screws 75; in the slide unit 62, the sliding block 68, the body 66 and the further sliding block 72 are constrained between each other and the secondary rail 32 by means of vertical screws 76.

The lower guide mechanism 80 comprises a lower rail 81 and a rod 82, both extended in the opening A direction and coupled between them; the rod 82 is above the lower rail 81.

The lower rail 81 is mounted at the bottom on the casing 11, near the base 13, fastened by means of a second translation mechanism 83 (not shown in detail nor described as it is per se conventional), which allows the translation of the lower rail 81 being brought closer to and farther away from the casing 11, in the approach direction B. The rod 82 is fastened to the door 20, at a lower edge 22 thereof.

The lower rail 81 has a U section, with two vertical and opposite tracks 84 and 85.

The lower guide mechanism 80 further comprises a third slide unit, which comprises a plurality of rolling members 86, formed of vertical-axis rollers, supported by the rod 82 and facing downwards, in sliding engagement with the two vertical tracks 84 and 85, between each other.

In use, i.e. when the door 20 is being opened, the second translation mechanism 83 is driven in a synchronised way with the first translation mechanism 33, such that, in the approaching and distancing movements, the door 20 keeps a vertical position.

As said, the door 20 is always hung to the casing 11 by means of the upper guide mechanism 30. It loads its own weight on the secondary rail 32 and from it on the primary rail 31 by the slide unit 61 and 62; finally, the primary rail 31 loads in turn the weight on the casing 11, by the translation mechanism 33. The lower guide mechanism 80 is not involved in supporting the weight of the door 20, while it only controls the vertical orientation thereof.

When the door 20 is opened, it is slid such that the secondary rail 32 moves along the primary rail 31, reaching a cantilever position. In this position, obviously, the static conditions of the showcase 10 are most critical, as the whole weight of the door 20 exerts on the upper guide mechanism 30 not only the maximum bending moment, but also a twisting moment, due to the horizontal distance between the secondary rail 32 and the primary rail 31. Both of these stresses, however, may be supported safely thanks to the slide units 61 and 62, which are tightly fastened on the primary and secondary rails, while allowing the relative sliding thereof.

It is thus not required to oversize unacceptably the primary and secondary rails to guarantee the static stability of the showcase 10, not even in a condition of total opening of the door 20.

The invention claimed is:

1. A museum showcase comprising a casing, at least one sliding door and a guide system for a sliding door, wherein the guide system comprises an upper guide mechanism and a lower guide mechanism, and wherein the door is hung on the casing through the upper guide mechanism, which bears the weight of the door while the lower guide mechanism determines the inclination of the door in relation to a vertical direction, wherein the upper guide mechanism comprises:

a primary rail and a secondary rail, placed side by side and extended parallel in a same opening direction for opening the door (20), wherein the primary rail is fastened to the casing and is extended between a first end and a second end, and the secondary rail is fastened to the door at one of the upper edges thereof and is extended between a first end and a second end, wherein the secondary rail is mounted sliding in relation to the primary rail along said opening direction, in such a way that it can slide between a closed position of the door and an open position of the door, wherein in the closed position of the door the first and the second end of the secondary rail are respectively at the first and the second end of the primary rail, while in the open position of the door the second end of the secondary rail is brought closer to the first end of the primary rail and brought farther away from the second end of the primary rail;

a first slide unit fastened to the primary rail at its first end and in sliding engagement with the secondary rail, and a second slide unit fastened to the secondary rail at its second end and in sliding engagement with the primary rail, wherein the first slide unit comprises a rolling member in sliding engagement from below on a top horizontal track of the secondary rail facing downwards, and a sliding block engaged on a vertical track of the secondary rail facing the opposite side of the primary rail, and wherein the second slide unit comprises a rolling member in sliding engagement from above on a lower horizontal track of the primary rail facing upwards, and a sliding block engaging on a vertical track of the primary rail facing the opposite side of the secondary track.

2. The showcase according to claim 1, wherein the first slide unit comprises a further sliding block engaged on a further vertical track of the secondary rail facing the opposite side of the primary rail, and wherein the second slide unit comprises a further sliding block engaged on a further vertical track of the primary rail facing the opposite side of the secondary rail, the further vertical tracks of the primary rail and of the secondary rail being spaced vertically in relation to the respective vertical tracks.

3. The showcase according to claim 2, wherein—in each slide unit—the sliding block and the further sliding block are constrained to each other in the vertical direction and embrace the primary or secondary rail on which they are in sliding engagement on opposite sides in the vertical direction.

4. The showcase according to claim 1, wherein the sliding blocks and any further sliding blocks are in a sliding engagement directly on the respective vertical tracks.

5. The showcase according to claim 1, wherein the sliding blocks and any further sliding blocks are in sliding engagement on the respective vertical tracks through interposition of rolling members.

6. The showcase according to claim 1, wherein the primary rail and/or the secondary rail have a C or tilted H cross section.

7. The showcase according to claim 1, wherein the lower guide mechanism comprises:

a lower rail and a rod placed side by side and extended parallel in the opening direction of the door, wherein one of the lower rail and the rod is fastened to the casing while the other is fastened to the door, at one of its lower edges, a third slide unit, comprising a plurality of rolling members or sliding blocks, mounted on the rod and engaged between two vertical tracks facing the lower rail.

8. The showcase according to claim 7, wherein the rolling members of the third sliding assembly are vertical-axis rollers.

9. The showcase according to claim 1, wherein the primary rail and the lower rail, if present, are fastened to the casing through respective translation mechanisms, so as to be able to take a position close to the casing and a position spaced from the casing.

* * * * *